United States Patent [19]

Iiams, Jr.

[11] Patent Number: 4,502,686

[45] Date of Patent: Mar. 5, 1985

[54] SYMMETRICAL FOLDED ALLEY GAME BOARD

[76] Inventor: Donald E. Iiams, Jr., 6201 Garden Rd., No. G-124, Maumee, Ohio 43537

[21] Appl. No.: 599,273

[22] Filed: Apr. 11, 1984

[51] Int. Cl.[3] ..... A63D 3/00; A63F 7/00

[52] U.S. Cl. ..... 273/126 R; 273/39

[58] Field of Search ..... 273/39, 118 R, 118 A, 273/118 D, 121 R, 124 R, 126 R, 126 A

[56] References Cited

U.S. PATENT DOCUMENTS

| | | | |
|---|---|---|---|
| 1,051,613 | 1/1913 | Miller | 273/39 |
| 2,159,966 | 5/1939 | Dunham | 273/126 R |
| 2,990,180 | 6/1961 | Koci | 273/126 A |
| 3,219,349 | 11/1965 | Smith | 273/126 R |
| 3,762,711 | 10/1973 | Cooper | 273/126 R |

*Primary Examiner*—Harland S. Skogquist
*Attorney, Agent, or Firm*—David D. Murray

[57] ABSTRACT

A amusement game includes a pair of symmetrical, folded alleys which meet at a common, centrally disposed scoring region. Each of the folded alleys includes a gutter disposed on each side thereof and a first rebounding barrier extending generally across the alley and oriented at a 45° angle. A second rebounding barrier is oriented at a right angle to a first rebounding barrier and forms a chevron shaped pattern; one end of each of the barriers being disposed in close proximity. A common scoring region is disposed generally intermediate the second rebounding barriers of the pair of folded alleys. The scoring region includes a pair of parallel gutters as well as indicia disposed within scoring boundary lines indicating a score or point value for placing a game piece within the associated boundary.

19 Claims, 6 Drawing Figures

SYMMETRICAL FOLDED ALLEY GAME BOARD

BACKGROUND OF THE INVENTION

The instant invention relates generally to game boards and more particularly to a table top game board having a pair of folded alleys which meet at a common scoring region.

Table top game boards of various sizes and designs have long been popular as amusement devices. Frequently they are scaled down counterparts of games initially designed as outdoor games. Just as frequently they incorporate variations and additions either permitted or necessitated by their smaller size which add to the fun and challenge of playing.

One general class of games which has undergone such diminution, variation and addition are those which may be generally classified as alley or shuffle board games. Several such board games are the subjects of United States patents. For example, U.S. Pat. No. 2,312,882 illustrates a game board having a single alley bounded at one end and along portions of both sides by resilient bumpers. At the opposite end is a common shooting and scoring area delineated on three sides by a gutter. It is apparent that the common shooting and scoring area can inhibit certain plays and scoring strategies. U.S. Pat. No. 2,990,180 discloses a similar device having a centrally disposed divider which extends along a portion of the playing surface thereby dividing it into first and second shooting and scoring alleys. While this configuration separates the shooting and scoring areas of one player from those of the other, this separation may reduce the challenge of the game inasmuch as players are unable to displace the playing pieces of their opponents from one scoring location to another.

U.S. Pat. No. 3,174,752 teaches a variation of the above-discussed U.S. Pat. No. 2,990.180. Here, a pair of similar alleys are disposed at an acute angle to one another. A rebounding surface disposed across the intersecting common ends of both alleys is so positioned that is permits a single rebound return from the alley of one player to the alley of the other. U.S. Pat. No. 3,239,226 illustrates a miniature curling game table having a movable surface. A single alley includes a shooting area at one end and a circular scoring region at the other surrounded on three sides by rectilinear gutters. Table surfaces are movable to simulate the action of a curling stone on ice.

U.S. Pat. No. 3,762,711 discloses a portable shuffle board game having a single folded alley with adjacent shooting and scoring regions at one end of the game board and a rebounding barrier at the other. Although this device permits players to displace their opponent's pieces in the scoring region, both must use the same shooting alley which is inconvenient and which detracts from the competitive nature of such a game.

From a review of the foregoing devices disclosed in these United States patents, it becomes apparent that additional improvements in the art of table top amusement games are both possible and desirable.

SUMMARY OF THE INVENTION

The instant invention relates to a symmetrical folded alley board game where two or more players compete to achieve the highest final score by placing playing pieces in a scoring region. The board game includes a pair of symmetrical, folded alleys which meet at a centrally disposed scoring region. Each of the alleys includes a shooting region which is disposed on opposite ends of the board and is defined on two sides by a pair of parallel gutters. At the end of each alley opposite the shooting region is disposed a first resilient rebounding barrier positioned and extending substantially across the alley at an angle of 45°. A second resilient rebounding barrier is associated with each of the alleys and is oriented at a right angle to each of the first resilient barriers. A common scoring region is disposed generally intermediate the second resilient barriers of the pair of folded alleys. The scoring region includes a pair of parallel gutters as well as scoring boundaries and indicia disposed within the scoring boundaries which indicate a score or point value of playing pieces positioned there within. A pair of parallel longitudinal barriers generally separates the shooting alleys from both the rebounding region of the other alley as well as from the common scoring region.

The symmetrical folded alley game board according to the instant invention thus places opponents at opposite ends of the game board which heightens the competitive nature of the play. The common scoring area not only renders the game board more compact than it would if it were to include two scoring areas but also encourages competition in the scoring region by permitting one player to displace the scoring game pieces of his opponent. The gutters increase the difficulty of the game and heighten competition. Various gutter arrangements adjacent the scoring region may be utilized to increase the difficulty of play, if desired.

It is thus the object of the instant invention to provide a game board which permits two or more players to compete by moving playing pieces along a pair of parallel, opposed alleys, against angularly disposed rebounding barriers, and into a common scoring region.

It is a further object if the instant invention to provide a game board wherein competition is enhanced by virtue of the face-to-face position of the players.

It is a still further object of the instant invention to provide a table top amusement game for two or more players having a common scoring area in which players may displace the playing pieces of their opponents.

It is a still further object of the instant invention to provide a game board which is straight-forward, readily manufactured and fun to play.

Further objects and advantages of the instant invention will become apparent by referring to the following description of the preferred embodiment and appended drawings.

DESCRIPTION OF THE PREFERRED EMBODIMENTS

Figure 1:
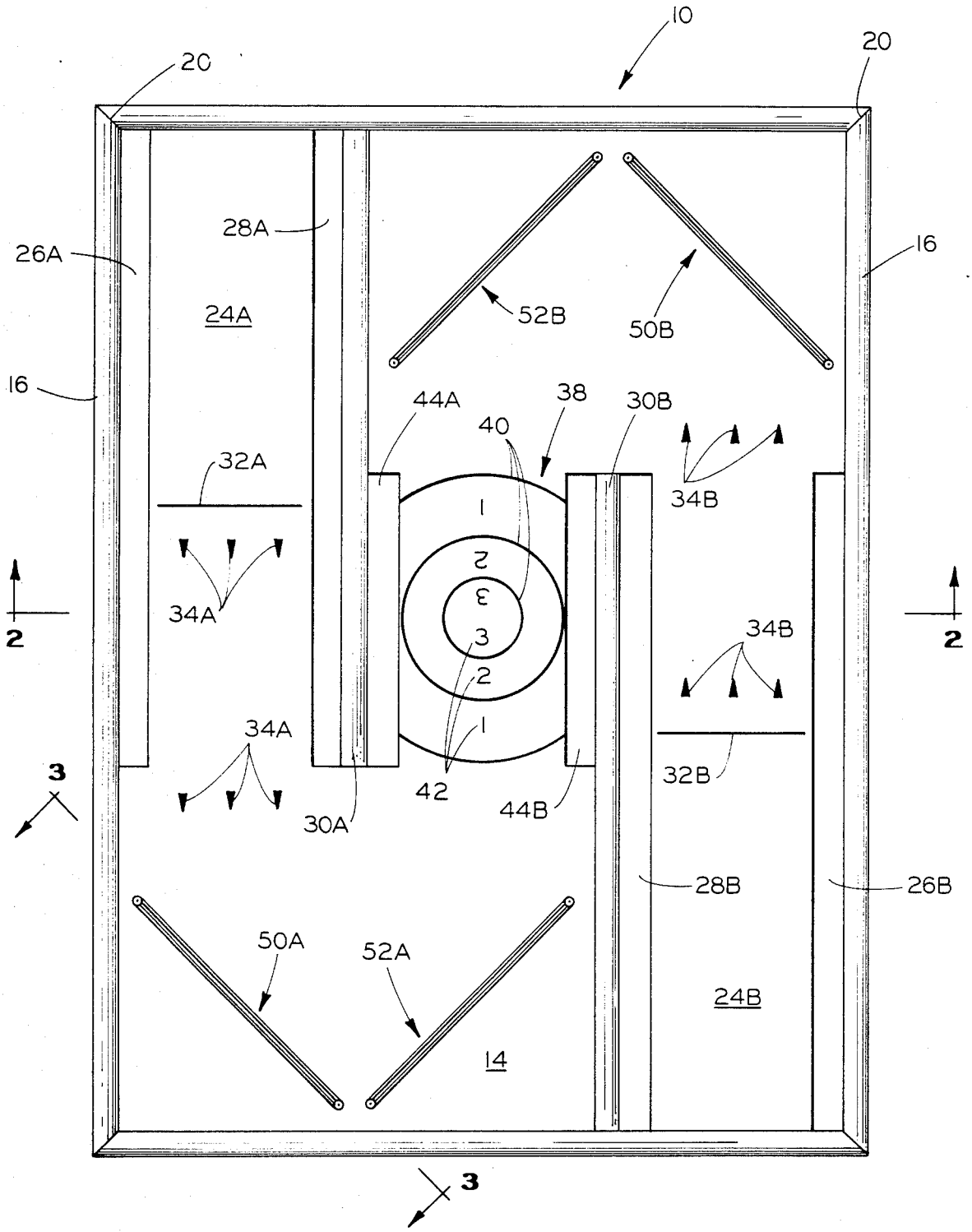
FIG. 1 is a plan view of a symmetrical folded alley amusement game board according to the instant invention.
Figure 2:
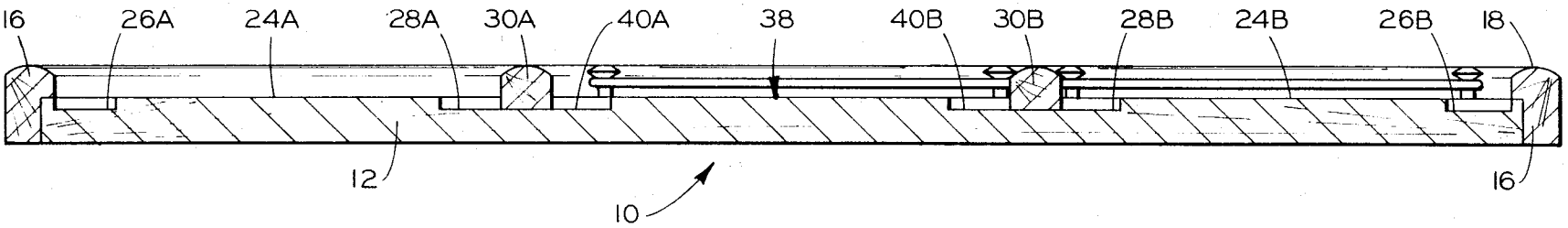
FIG. 2 is a full, sectional view of a symmetrical folded alley game board according to the instant invention taken along line 2—2 of FIG. 1.

Referring now to FIGS. 1 and 2, a plan view of a table top amusement game such as a symmetrical folded alley game board according to the instant invention is provided wherein such board game assembly is generally designated by the reference numeral 10. The game board assembly 10 includes a base portion 12 having a generally planar upper surface 14. The upper surface 14 is divided into various alleys and a common scoring region as will be more fully explained subsequently. The base 12 and particularly the upper surface 14 is preferably bounded on all sides by a peripheral rail 16 having a generally hemispherical upper edge profile 18. Chamferred corners 20 may be included, if desired, to further enhance the overall appearance of the game board assembly 10. As noted, the planar upper surface 14 includes a pair of symmetrically disposed first and second shooting alleys 24A and 24B disposed in parallel fashion along the longer side rails 16 and extending in opposite directions from opposite ends of the game board assembly 10. The first shooting alley 24A is defined and narrowed along a portion of its length on both sides by a pair of parallel gutters 26A and 28A. The outside gutter 26A is disposed adjacent and parallel to the inner surface of the peripheral rail 16 whereas the inside gutter 28A is limited and defined by a co-extensive barrier 30A. The gutters 26A and 28A as well as the barrier 30A extend from the peripheral rail 16 at one end to somewhat beyond the longitudinal midpoint of the planar surface 14. In a similar fashion, the second shooting alley 24B includes a pair of parallel gutters 26B and 28B which define and narrow the alley 24B along a portion of its length. The gutters 26B and 28B are disposed symmetrically on the surface 14 with regard to the gutters 26A and 28A. The outside gutter 26B is adjacent and parallel to the inner surface of the peripheral rail 16 and the inside gutter 28B likewise is defined by a co-extensive barrier 30B which, again, is symmetrically disposed on the surface 14 with regard to the barrier 30A. The barriers 30A and 30B extend longitudinally along the game board assembly 10 and are disposed such that they transversely divide the width of the planar surface 14 into approximately thirds such that the full width of the shooting alleys 24A and 24B including the associated gutters 26A and 28A and 26B and 28B, respectively, each occupy approximately one third of the planar surface 14.

On the planar surface 14 of the shooting alleys 24A and 24B and disposed transversely between the respective gutters 26A and 28A or 26B and 28B at about their midpoints are marked foul lines 32A and 32B, respectively, which may be painted thereon or applied by silkscreen, decals or similar means. Optionally, there may also be included pluralities of directional arrows 34A and 34B which indicate the direction of the play, if desired. Centrally disposed on the planar upper surface 14 and in the region of overlap of the barriers 30A and 30B is disposed a scoring region 38. The scoring region 38 includes a plurality of scoring markers or boundaries 40 which may be painted on the planar surface 14 or applied by decals, silkscreen, or similar means. Within the scoring boundaries 40 are indicia 42 representative of certain point values which may be assigned to play pieces landing therein as will be readily understood. On opposite sides of the scoring region 42 and extending along the region of overlap of the barriers 30A and 30B are a pair of parallel, symmetrically disposed gutters 44A and 44B. The gutters 44A and 44B are preferably similar to the previously described gutters 26A, 28A, 26B and 28B and, in a like manner, define and narrow the scoring region 38.

Finally, disposed in alignment with each of the alleys 24A and 24B at their ends most distant the respective gutters 26A and 28A or 26B and 28B are first resilient rebound or barrier assemblies 50A and 50B. The resilient barrier assemblies 50A and 50B are preferably disposed at an angle of 45° to the longitudinal axes of the respective alleys 24A and 24B but may be oriented at a somewhat greater or lesser angle if desired. Preferably disposed at a right angle to the resilient barrier assembly 50A, defining a generally chevron shaped pattern therewith and having ends spaced a small distance apart is a second resilient barrier assembly 52A. Whereas the first resilient barrier assembly 50A is generally aligned with and extends obliquely across the alley 24A, the second resilient barrier assembly 52A is generally aligned with and extends obliquely across a region adjacent the scoring area 38. Similarly, the first barrier assembly 50B aligned with and generally extending obliquely across the second alley 24B has associated with it a second resilient barrier assembly 52B preferably oriented at a right angle thereto. Again, the first and second resilient barrier assemblies 50B and 52B define a generally chevron shaped pattern having adjacent ends spaced a small distance apart. The second resilient barrier assembly 52B is aligned with and generally extends obliquely across a region adjacent the scoring region 38 as will be readily apparent from FIG. 1.

Figure 3:
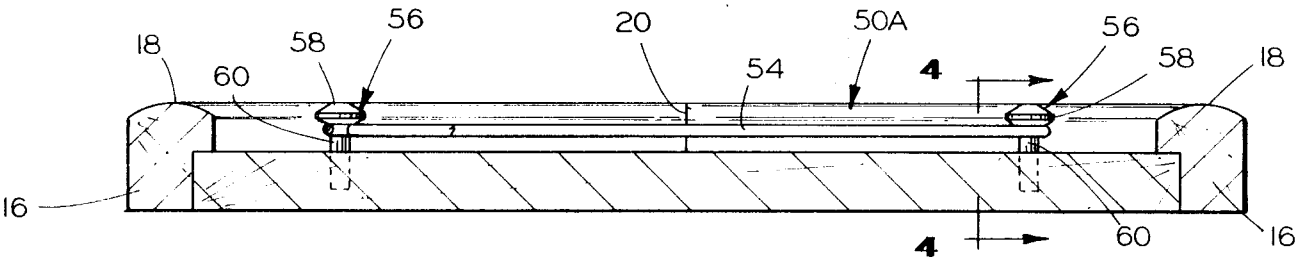
FIG. 3 is an enlarged, sectional view with a portion broken away of a resilient rebounding barrier according to the instant invention taken along line 3—3 of FIG. 1.
Figure 4:
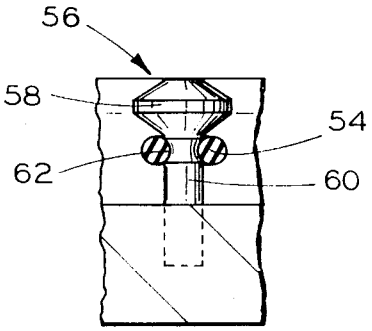
FIG. 4 is a fragmentary, sectional view of a resilient rebounding barrier and stanchion according to the instant invention taken along line 4—4 of FIG. 3.

It should be understood that the resilient barrier assemblies 50A, 50B, 52A and 52B are identical but for their positions and orientations. The first resilient barrier assembly 50A will therefore be described with reference to FIGS. 3 and 4, it being understood that the following description applies with equal force to the remaining three resilient barrier assemblies 50B, 52A and 52B. The first resilient barrier assembly 50A includes a band or belt 54. The belt preferably has a circular cross section as illustrated in FIG. 4 although a square or rectangular cross-section is wholly suitable. The belt 54 is preferably fabricated of rubber or a similar elastomeric material. The belt 54 extends between a pair of stanchions 56 which each includes a symmetrically chamferred head region 58 and a downwardly extending stem portion 60 which is received within a suitable blind opening in the base panel 12. Preferably, the stanchions 56 include a circumferential channel 62 disposed generally between the head region 58 and the stem 60 having a radius or configuration substantially equal to the radius or profile of the belt 54. The channel 62 ensures that the belt 54 will remain positioned at a suitably effective height above the planar surface 14 in order that playing pieces will be properly rebounded thereoff. It should be noted that the relaxed total length of each of the belts 54 should be somewhat less than twice the distance between a pair of the stanchions 56 associated with a given resilient barrier assembly such that the belt 54 will be stretched somewhat and thus provide a relatively live rebounding surface for the game pieces 64.

Figure 6:
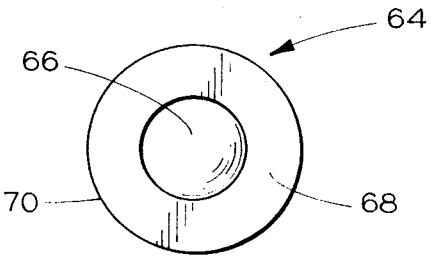
FIG. 6 is a top, plan view of a playing piece which may be utilized with the instant invention.
Figure 5:
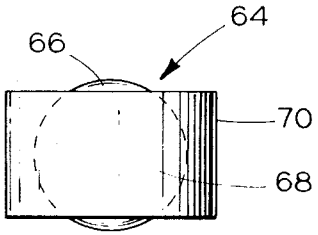
FIG. 5 is a side, elevational view of a playing piece which may be utilized with the instant invention.

FIGS. 5 and 6 illustrate a suggested form of a game piece for use with the board game assembly 10. Typically, such game pieces 64 include a spherical ball 66 disposed within an outer annular ring 68. So configured, the game piece 64 has a relatively low coefficient of friction on the planar surface 14, but because of the vertical sidewalls 70 of the annular ring 68, they rebound predictably from such surfaces as the resilient barriers 50A, 50B, 52A and 52B as will be readily appreciated.

The game board assembly 10 may be fabricated of any suitable material such as wood or plastic. For example, if fabricated of wood, the base panel 12 may be cut and routed to include the gutters 26A, 28A, 26B, 28B, 44A and 44B. The barriers 30A and 30B may then be positioned and secured appropriately by glue, screws or other fasteners. Suitably positioned openings may be formed in the base portion 12 to receive the eight stanchions 56 associated with the resilient barrier assemblies 50A, 50B, 52A and 52B. The stanchions 56 may then be secured in such openings by suitable adhesives and the four belts 54 strung therebetween. The peripheral rail 16 may then be attached and the various markings such as the foul lines 32A and 32B and other markings and indicia may then be placed on the planar surface 14 by any suitable means. Alternatively, the board game assembly 10 may be fabricated of a substantially unitary structure composed of suitable plastic such as polystyrene, fiberglass reinforced plastic, acrylonitrile butadiene styrene (ABS) or similar appropriate lightweight and relatively high strength plastic. Such fabrication may be achieved by injection molding, blow molding, vacuum forming or other similar and well known techniques. Preferably, such a unitary structure will include integrally formed and appropriately positioned openings for receiving the stanchions 56 of the barrier assemblies 50A, 52A, 50B and 52B which may then be readily assembled. Markings and indicia may then be applied by any suitable means, as described above.

The foregoing disclosure is the best mode device by the inventor for practicing this invention. It is apparent, however, that apparatus incorporating modifications and variations will be obvious to one skilled in the art of amusement devices. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. An amusement game comprising, in combination, a generally planar surface defining a pair of opposed, symmetrically disposed parallel alleys extending between opposed ends of said planar surface, each of said alleys having a pair of gutters disposed on respective sides of said alley and extending along a portion of said alley, a barrier disposed adjacent at least one of said gutters on the side of said gutter opposite said alley, a central scoring region disposed generally intermediate said parallel alleys, a pair of gutters disposed generally adjacent said scoring region and parallel to said alley gutters and a pair of resilient barrier assemblies associated with each of said alleys, one of each of said pair of barrier assemblies disposed generally in alignment with and extending generally across one of said alleys in a region generally away from said gutters and the other of each of said pair of barrier assemblies disposed generally at a right angle to said one of said pair of barrier assemblies.

2. The amusement game of claim 1 wherein said planar surface is rectangular and includes a pair of opposed ends and a pair of opposed sides longer than said ends.

3. The amusement game of claim 2 wherein each of said pair of said parallel alleys extends parallel to and adjacent a respective one of said pair of longer, opposed sides.

4. The amusement game of claim 2 wherein said pair of parallel alleys, said gutters and said barriers all extend parallel to said longer, opposed sides of said generally planar surface.

5. The amusement game of claim 1 wherein said pair of resilient barrier assemblies are disposed in a symmetrical relationship on said planar surface relative to said alleys and said scoring region.

6. The amusement game of claim 1 wherein said resilient barrier assemblies each includes a pair of stanchions disposed in spaced-apart relation and resilient means extending between said stanchions for providing a rebounding surface.

7. The amusement game of claim 6 wherein said stanchions each include a circumferential channel for receiving said resilient means.

8. The amusement game of claim 6 wherein said resilient means is an elastomer belt having a circular cross section.

9. The amusement game of claim 1 wherein said scoring region includes boundary lines disposed on said planar surface and scoring indicia disposed within said boundary lines for indicating point value of a play piece disposed within said scoring boundary line.

10. A symmetrical folded alley game board comprising, in combination, a generally planar surface having opposed ends and defining a pair of opposed, symmetrically disposed parallel alleys extending between said opposed ends of said planar surface, each of said alleys defined by a pair of gutters disposed on respective parallel sides of said alley and extending along a portion of said alley and a pair of barriers disposed adjacent a respective one of said pair of gutters on the side of said gutters opposite said alley and extending at least a portion of the length of said alley, a central scoring region disposed intermediate said parallel alleys, a pair of gutters disposed generally adjacent said scoring region and parallel to said alley gutters and a pair of resilient barrier assemblies associated with each of said alleys and symmetrically disposed on said planar surface, one of each of said barrier assemblies disposed in alignment with and extending generally across one of said alleys in a region away from said gutters of said alley and the other of each of said pair of barrier assemblies disposed generally at a right angle to said one of said barrier assemblies.

11. The folded alley game board of claim 10 wherein said generally planar surface is rectangular and defines a pair of opposed sides longer than said opposed end and wherein said pair of alleys are disposed parallel to said sides.

12. The folded alley game board of claim 11 wherein said pair of resilient barrier assemblies are disposed in a symmetrical relationship on said planar surface relative to said alleys and said scoring region.

13. The folded alley game board of claim 10 wherein said resilient barrier assemblies each include a pair of stanchions disposed in spaced-apart relation and resilient means extending between said stanchions for providing a rebounding surface.

14. The folded alley game board of claim 13 wherein said resilient means is an elastomer belt having a circular cross section.

15. A symmetrical folded alley game board comprising, in combination, a generally planar surface having opposed ends and defining a pair of opposed, symmetrically disposed parallel alleys extending between said opposed ends of said planar surface, each of said alleys defined by a pair of gutters disposed on respective parallel sides of said alley and extending along a portion of said alley and a pair of barriers disposed adjacent a respective one of said pair of gutters on the side of said gutters opposite said alley and extending at least a portion of the length of said alley, a central scoring region disposed intermediate said parallel alleys, a pair of gutters disposed generally adjacent said scoring region and parallel to said alley gutters and a pair of resilient barrier assemblies associated with each of said alleys and symmetrically disposed on said planar surface, one of each of said barrier assemblies disposed in alignment with and extending generally across one of said alleys in a region away from said gutters of said alley and the other of each of said pair of barrier assemblies disposed generally at a right angle to said one of said barrier assemblies, each of said barrier assemblies including a pair of stanchions disposed in spaced-apart relation and resilient means extending between said stanchions for providing a rebounding surface.

16. The folded alley game board of claim 15 wherein said pair of resilient barrier assemblies are disposed in a symmetrical relationship on said planar surface relative to said pair of alleys and said central scoring region.

17. The folded alley game board of claim 15 wherein each of said stanchions includes a circumferential channel for receiving said resilient means.

18. The folded alley game board of claim 15 wherein said resilient means is an elastomer belt having a circular cross section.

19. The folded alley game board of claim 15 wherein said scoring region includes boundary lines disposed on said planar surface and scoring indicia disposed within said boundary lines for indicating point value of a play piece disposed within said scoring boundary line.

* * * * *